US007229319B2

(12) United States Patent
Dahms et al.

(10) Patent No.: US 7,229,319 B2
(45) Date of Patent: Jun. 12, 2007

(54) PRINTED BOARD CONNECTOR FOR DIFFERENTIAL SIGNAL TRANSMISSION

(75) Inventors: Thomas Dahms, Espelkamp (DE); Gert Havermann, Wallenhorst (DE); Andreas Kohler, Minden (DE)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 11/424,776

(22) Filed: Jun. 16, 2006

(65) Prior Publication Data

US 2006/0292921 A1 Dec. 28, 2006

(30) Foreign Application Priority Data

Jun. 24, 2005 (DE) ..... 20 2005 009 919 U

(51) Int. Cl.
*H01R 13/648* (2006.01)

(52) U.S. Cl. ..... 439/608; 439/108

(58) Field of Classification Search ..... 439/60, 439/101, 108, 608
See application file for complete search history.

(56) References Cited

U.S. PATENT DOCUMENTS 6,506,076 B2 1/2003 Cohen et al. ..... 439/608
6,533,614 B1 * 3/2003 Akama et al. ..... 439/608
6,537,086 B1 3/2003 Mac Mullin ..... 439/79
6,808,420 B2 10/2004 Whiteman, Jr. et al. .... 439/608
6,923,664 B2 * 8/2005 Ito et al. ..... 439/108
7,025,633 B2 * 4/2006 Kumamoto et al. ..... 439/608
2003/0123236 A1 7/2003 McGrath et al. ..... 361/760
2003/0143894 A1 7/2003 Kline et al. ..... 439/608
2003/0220021 A1 11/2003 Whiteman, Jr. et al. .... 439/608
2004/0072470 A1 4/2004 Lang et al. ..... 439/608
2004/0121655 A1 6/2004 Ling et al. ..... 439/682

* cited by examiner

*Primary Examiner*—Thanh-Tam Le
(74) *Attorney, Agent, or Firm*—Hayes Soloway P.C.

(57) ABSTRACT

In order, to transmit differential signals between two printed boards, there is provided a printed board connector comprising an insulating connector housing and disk-shaped modules that contain electric contact elements and are arranged in the connector housing, wherein modules featuring signaling contacts and modules featuring shielding contacts are alternately arranged adjacent to one another. In this case, the shielding module is realized in such a way that signaling contact pairs arranged on top of one another are also at least regionally shielded relative to one another.

13 Claims, 8 Drawing Sheets

PRINTED BOARD CONNECTOR FOR DIFFERENTIAL SIGNAL TRANSMISSION

FIELD OF THE INVENTION

The invention pertains to a printed board connector for producing direct pluggable connections between printed boards, wherein said connector consists of an insulating connector housing and disk-shaped modules that contain electric contact elements and are arranged in the connector housing, and wherein modules featuring signaling contacts and modules featuring shielding contacts are alternately arranged adjacent to one another.

BACKGROUND OF THE INVENTION

A printed board connector of this type is required for transmitting differential signal voltages from one printed board to another printed board by means of a large number of electric contacts, wherein contacts that are shielded in pairs are provided in order to ensure a low feedover between the line pairs.

DESCRIPTION OF THE RELATED ART

U.S. Pat. No. 6,506,076 discloses a rectangular connector, in which at least partially angled shielding plates are positioned between a series of differential signaling contacts that are arranged in rows and columns.

SUMMARY OF THE INVENTION

The invention therefore is based on the objective of developing a printed board connector of the initially cited type in such a way that a two-pole signal conduction is respectively provided in order to transmit differential signals, wherein correspondingly designed shielding plates are provided between the signal-conducting line pairs for shielding purposes.

This objective is attained in that two respective signaling contacts that form a differential pair are at least regionally separated by a shielding contact arranged between the signaling pairs.

The printed board connector serves for connecting two printed boards that are arranged at a right angle to one another. However, it would also be possible to realize a "straight" 180° connection referred to the printed boards if the terminal contacts are designed accordingly.

In order to preserve the advantages of a differential data transmission on the path from the electronic components to the printed board or the backplane, respectively, correspondingly designed high-capacity connectors are required that not only ensure a sufficient signal density, but also a high signal integrity.

Differential signals, in principle, are largely immune to common-mode interferences because the logic information is transmitted in the form of the voltage difference between the respective line pairs. However, it needs to be ensured that the line pairs are shielded accordingly. In connectors designed for this purpose, this is achieved by means of integrated and specially constructed shielding plates.

The advantages attained with the invention can be seen, in particular, in that the inventive printed board connector makes it possible to shield a plurality of differential signaling pairs that are arranged in a row from interfering radiation by inserting modules that feature a shielding plate in the form of a disk between the signaling modules that are respectively arranged adjacent to one another in pairs and in which the signaling contacts are embedded. The modules are preferably realized in the form of signaling and shielding modules that can be inserted into the connector housing adjacent to one another in a certain pattern, wherein two adjacently arranged signaling modules are respectively separated by a shielding module.

According to one variation, this is achieved by inserting shielding modules in the form of disk-shaped plates into the connector housing. In another variation, the shielding modules are realized in the form of modules that are covered with an insulating material.

In this case, it is advantageous that an angled terminal end pointing from the shielding module to the printed board is respectively arranged between the two differential signaling contacts.

Two individual contacts that are arranged adjacent to one another in two modules respectively form a differential signaling pair. Another differential signaling pair is arranged opposite of this differential signaling pair. Consequently, two adjacently arranged strip conductors form a differential signaling pair and are separated by another strip conductor for shielding purposes on each side of the inserted printed board.

BRIEF DESCRIPTION OF THE DRAWINGS

One embodiment of the invention is illustrated in the figures and described in greater detail below. The figures show.

DETAILED DESCRIPTION OF THE INVENTION

Figure 1:
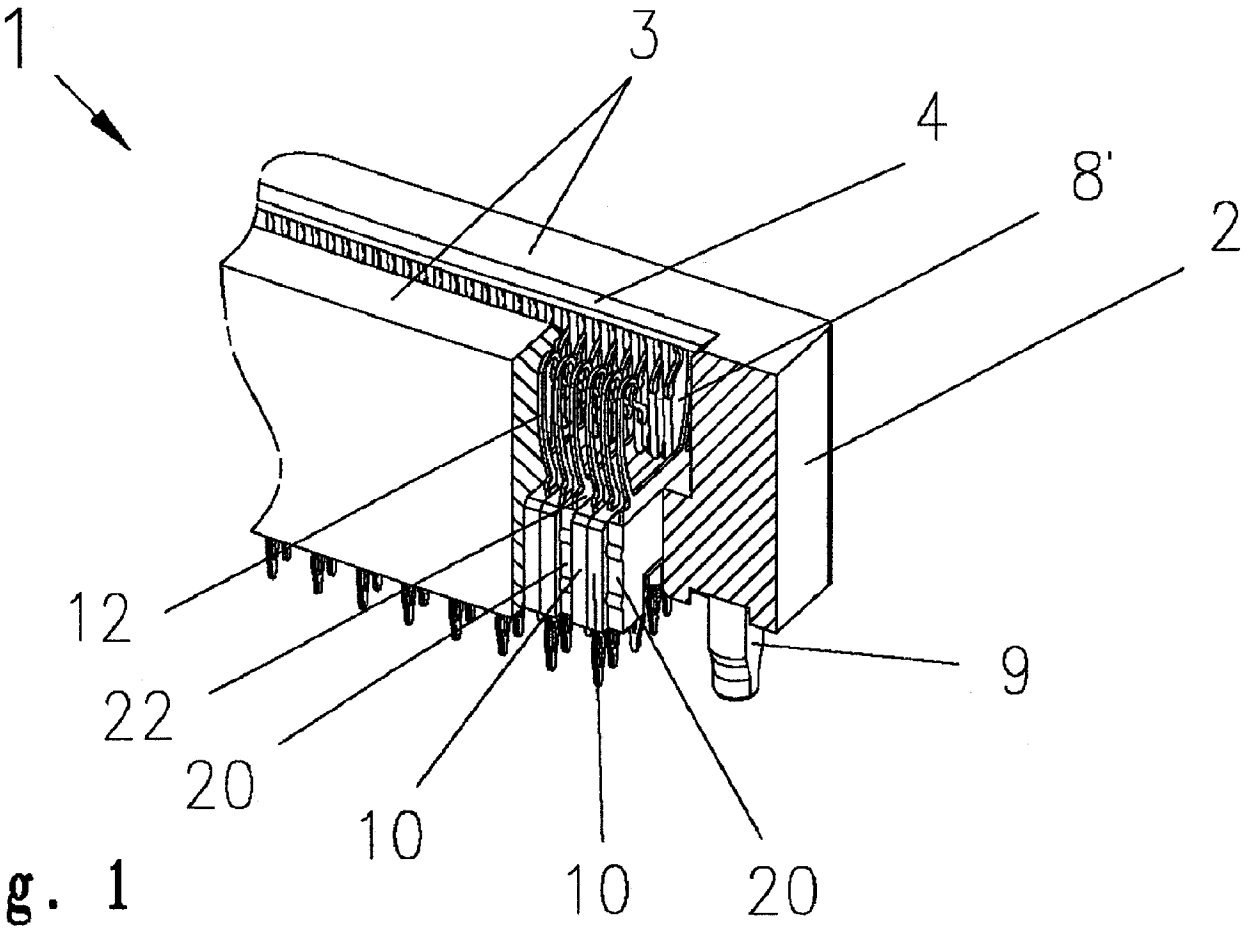
FIG. 1 is a perspective representation with a section through the interior of a printed board connector.

FIG. 1 shows a perspective side view of a segment of a printed board connector 1 with a partially sectioned region.

The printed board connector consists of a connector housing 2 with an insertion slot 4 on the mating side for inserting a printed board between the disk-shaped modules 10, 20 illustrated in the sectioned region, wherein said modules are arranged in a certain sequence between the longitudinal sides 3 of the connector housing.

The plug contacts 12, 22 described further below are embedded in the disk-shaped modules 10, 20 and respectively arranged in the connector housing between chamber-forming walls 8' such that they are prevented from being bent by the inserted printed board.

Figure 2:
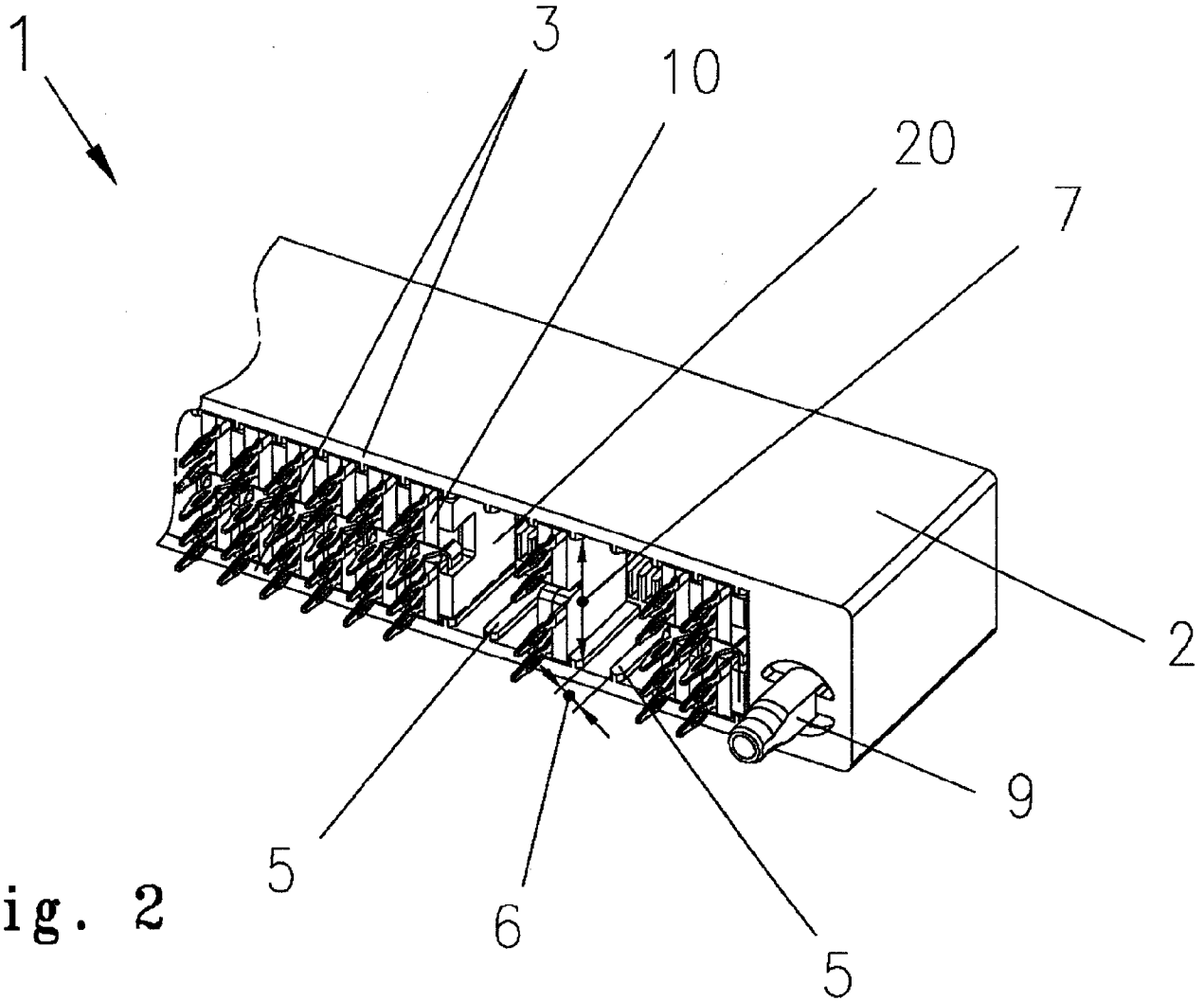
FIG. 2 is a perspective representation of the terminal side of the printed board connector.

FIG. 2 shows a perspective representation of a segment of the terminal side of the connector housing 2, as well as the modules 10, 20 arranged therein in the form of a row.

In this case, two respective signaling modules 10 containing signaling contacts 11 and a shielding module 20 with a flat shielding plate 21 (seen in FIG. 6*c*) embedded therein are continuously arranged adjacent to one another. This figure also shows a region in the connector housing 2, in which the modules 10, 20 are removed so as to illustrate integral webs 5 that protrude into the housing interior from the two opposite longitudinal sides 3. Two signaling modules 10 are respectively inserted into the horizontal intermediate space 6 formed by the two webs 5. The shielding modules 20 are inserted into the vertical clear space 7 between the webs 5. In addition, a mounting post 9 is provided for holding the housing on a corresponding printed board in a mechanically stable fashion.

Figure 3:
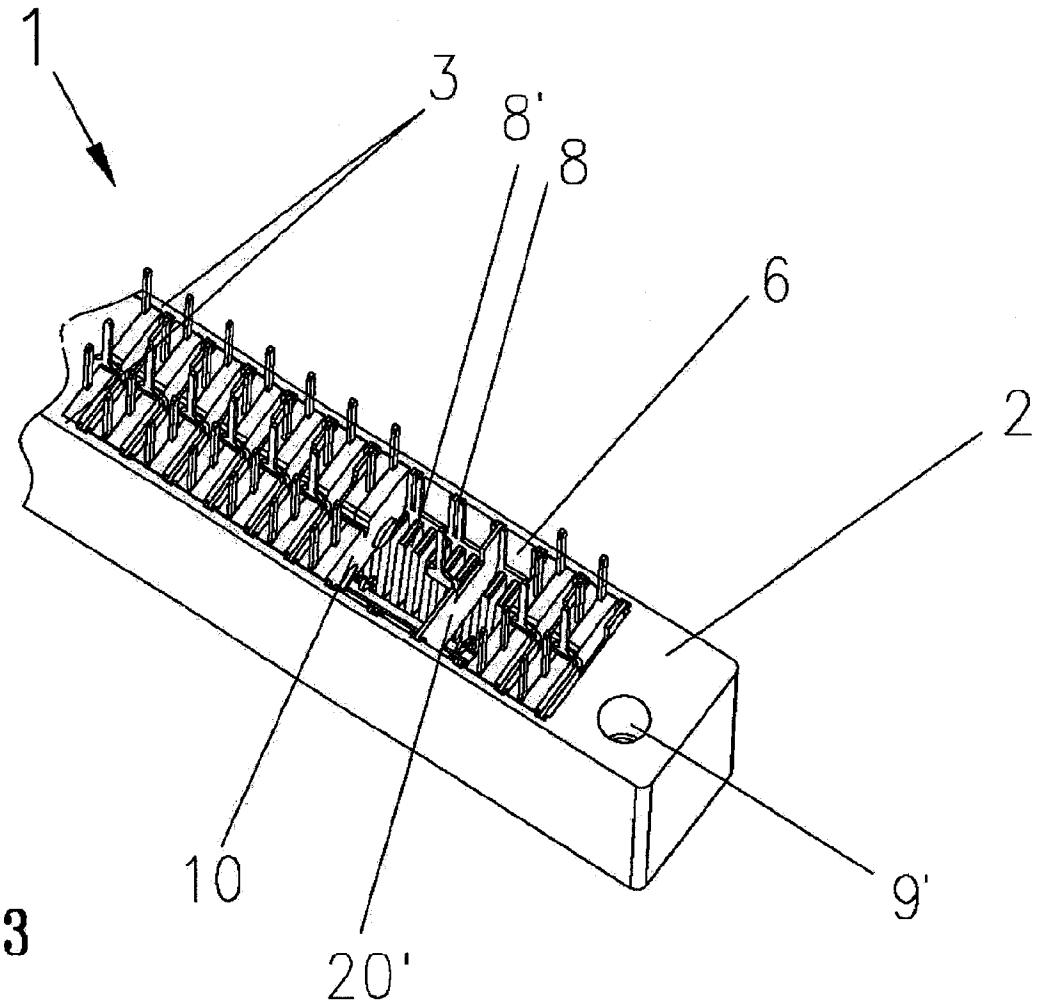
FIG. 3 is a perspective representation of the terminal side of a modified printed board connector.

FIG. 3 shows a variation of the connector housing 2, in which insertion slots 8 are provided in both longitudinal sides 3 instead of the webs 5. In this case, the shielding modules 20' to be inserted into these insertion slots are merely realized in the form of a flat shielding plate 21 without a covering insulating member.

In other respects, the arrangement of the signaling modules and the shielding modules is identical to that shown in FIG. 2. In this figure, the post is replaced with a bore 9' that serves for accommodating a not-shown external mounting means.

Figure 4:
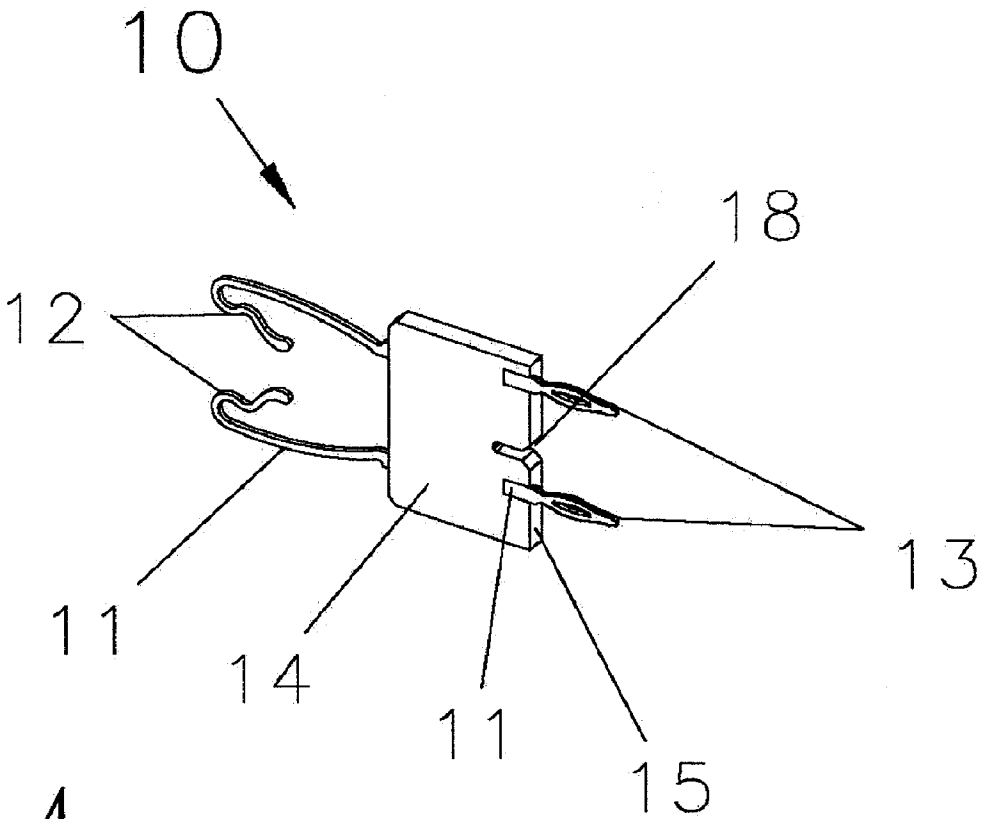
FIG. 4 is a perspective representation of a signaling module.

FIG. 4 shows a perspective representation of a signaling module 10. The disk-shaped module consisting of a non-conductive insulating member 14 surrounds two electric signaling contacts 11 that are embedded independently of one another in this case, wherein these electric signaling contacts feature two springable plug contacts 12 that point toward one another, as well as two terminal ends 13 that are realized in the form of press-in contacts in this case.

In addition, the module contains a slot 18 on the side of the terminal ends 13 that is approximately arranged centrally referred to the insulating member, wherein the angled terminal end 23 of the adjacent shielding module 20 protrudes into said slot when the connector is assembled.

FIGS. 5*a*–*d* show a variation of the signaling module 10 illustrated in FIG. 4.

Figure 5A:
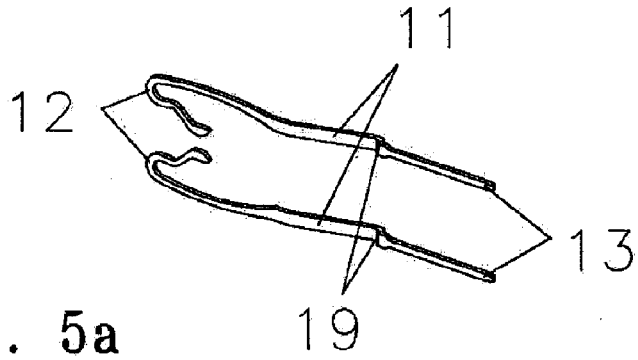
FIG. 5*a* is a horizontal projection of detached signaling contacts.

FIG. 5*a* shows the two signaling contacts 11 with the plug contacts 12 and the terminal ends 13 that are realized in the form of soldering contacts in this case. In addition, a double bend 19 is provided such that the stretched shape of the signaling contacts is preserved.

Figure 5B:
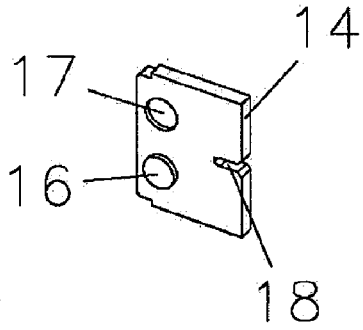
FIG. 5*b* is a horizontal projection of an insulating member.

FIG. 5*b* shows a variation of the insulating member 14, in which a button 16 and a recess 17 are respectively arranged alternately on the two peripheral surfaces of the insulating member in order to center the insulating members relative to one another.

Figure 5C:
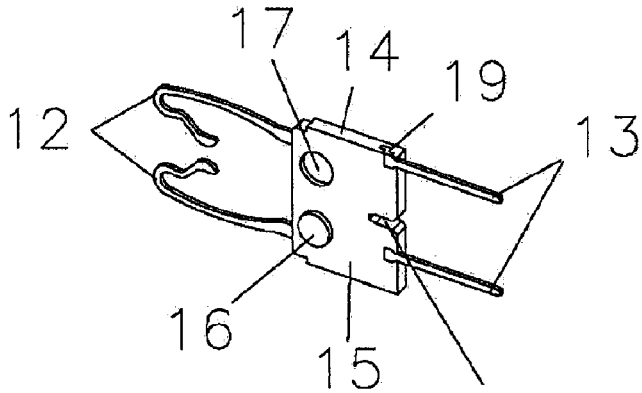
FIG. 5*c* is a horizontal projection of the complete signaling module.

FIG. 5*c* shows a complete signaling module.

Figure 5D:
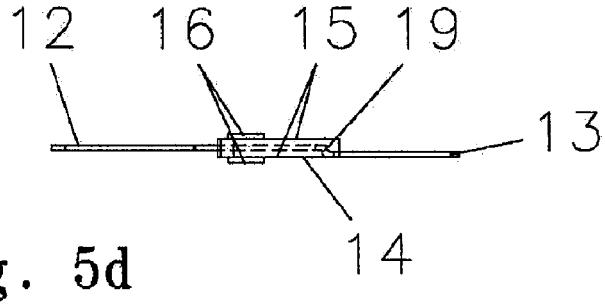
FIG. 5*d* is a top view of the narrow side of the signaling module.

FIG. 5*d* shows a top view of the arrangement of the signaling contacts 11 within the insulating member 14 that is illustrated with broken lines in this case, wherein this figure also shows that a bend 19 is provided—still within the insulating member—near the outlet region on the terminal end 13 such that the signaling contact 11 extends asymmetrically referred to a central position on the mating side and flush with the outer periphery 15 of the insulating member 14 at the terminal end.

FIG. 6 shows two variations of the shielding module 20 in the form of a perspective representation.

Figure 6A:
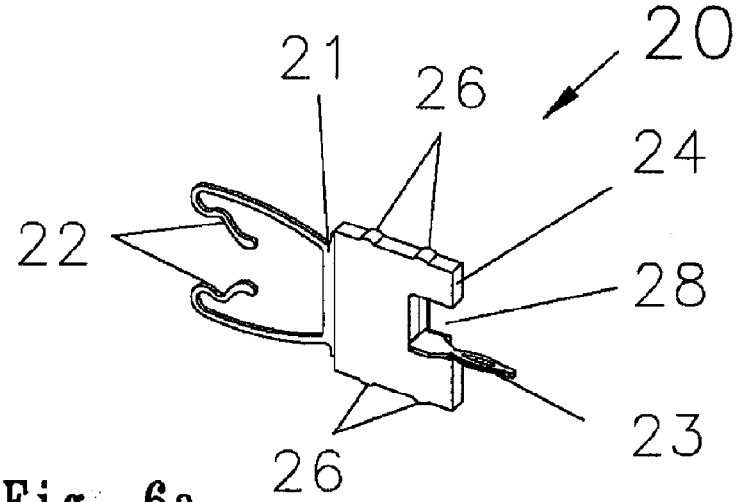
FIG. 6*a* is a perspective representation of a shielding module.

FIG. 6*a* shows the disk-shaped module 20 consisting of a non-conductive insulating member 24, in which a flat, electrically conductive shielding contact 21 is arranged.

The mating side features two springable plug contacts 22 that point toward one another while the terminal end 23 is bent out of the shielding contact 21 at a right angle.

Figure 6B:
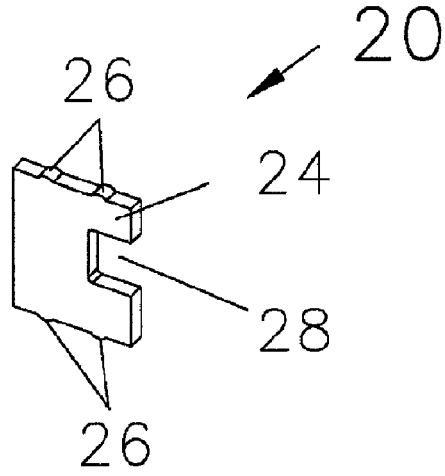
FIG. 6*b* is a horizontal projection of the insulating member of the shielding module.
Figure 6C:
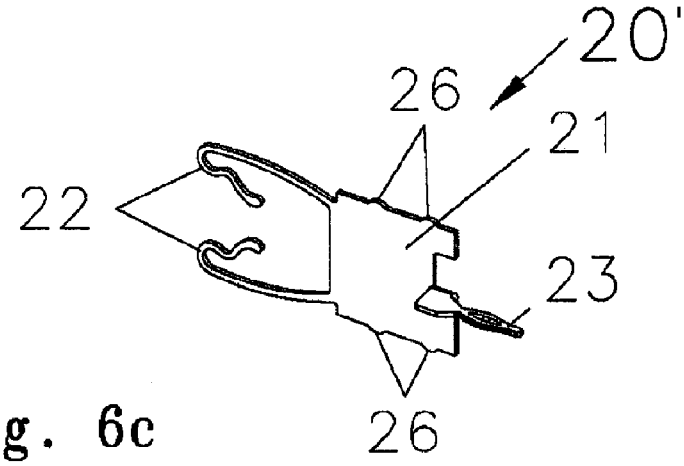
FIG. 6*c* is a horizontal projection of a variation of the shielding module.
Figure 7:
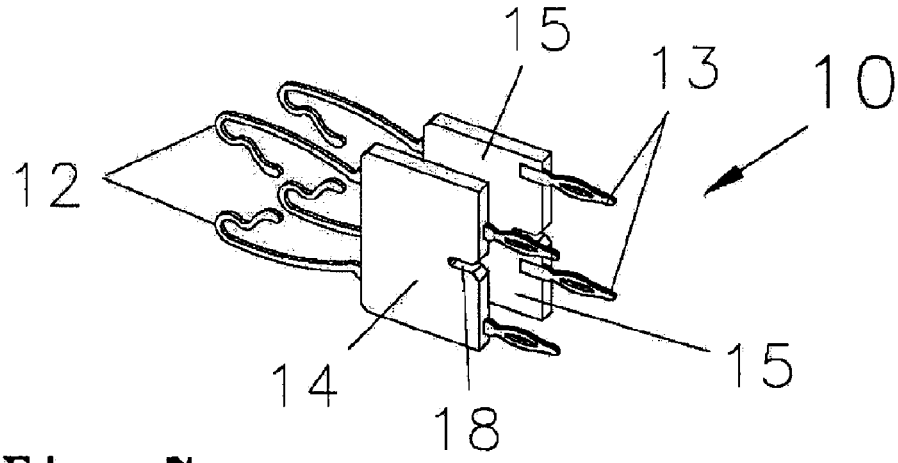
FIG. 7 is a perspective representation of two adjacently arranged signaling modules.

FIG. 6*b* shows an insulating member 24, in which a recess 28 for the angled terminal end 23 is provided. This figure also shows the segment-shaped press-on zones 26 that are respectively molded onto the opposing sides in pairs and ensure a secure retention in the connector housing 2. FIG. 6*c* shows a variation of the shielding module 20, in which the insulating cover of the insulating member 24 is omitted and the press-on zones 26 are directly molded onto the flat shielding contact 21.

In this variation, the shielding module is inserted into corresponding slots 8 in the longitudinal sides 3 of the connector housing.

modules 10 according to FIG. 4, one of which is turned about its plug-in axis by 180°.

If the modules are arranged tightly adjacent to one another, the plug contacts 12 are embedded symmetrically referred to the insulating member 14 and arranged adjacent to one another in a uniformly spaced-apart fashion.

The plug contacts 12 are also arranged at a uniform height in order to contact the strip conductors on the printed board.

The terminal ends 13, however, are arranged at different heights because they respectively protrude from the insulating member in the first and in the third quarter of the insulating member height and are respectively offset in height by one quarter in the position with the 180° turn shown. Consequently, the terminal ends do not directly contact one another despite the directly adjacent arrangement on the peripheral surfaces 15.

Figure 8:
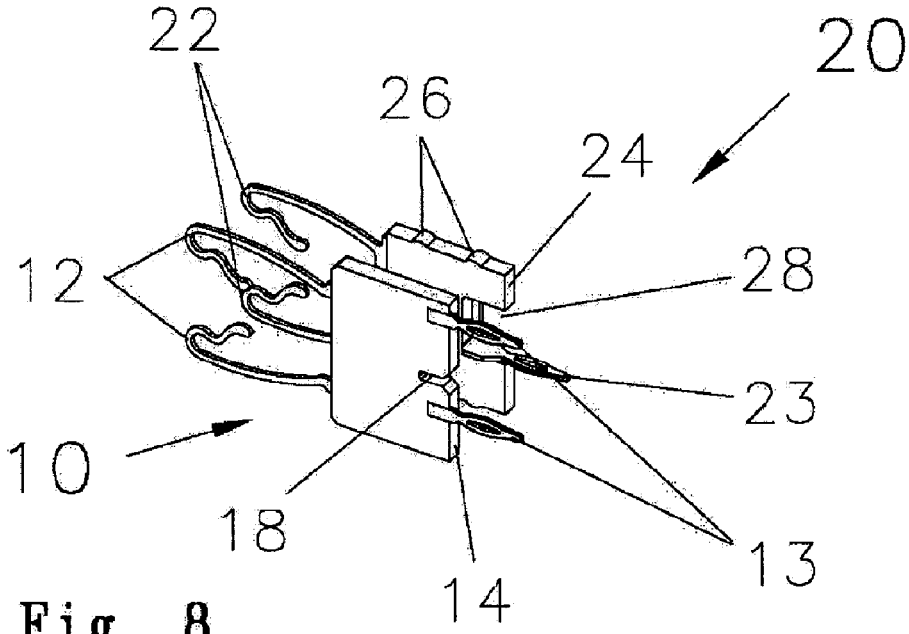
FIG. 8 is a perspective representation of a signaling module situated adjacent to a shielding module.

FIG. 8 shows a signaling module 10 and a shielding module 20 that are arranged adjacent to one another.

This figure shows how the angled terminal end 23 is inserted into the slot 18 between the two terminal ends 13. In this respect, it should be noted that the angled terminal end 13 of the shielding module extends into the slot 18 of the next two adjacent signaling modules 10 and thusly exerts a shielding effect upon the two differential electric signals to both sides.

Figure 9:
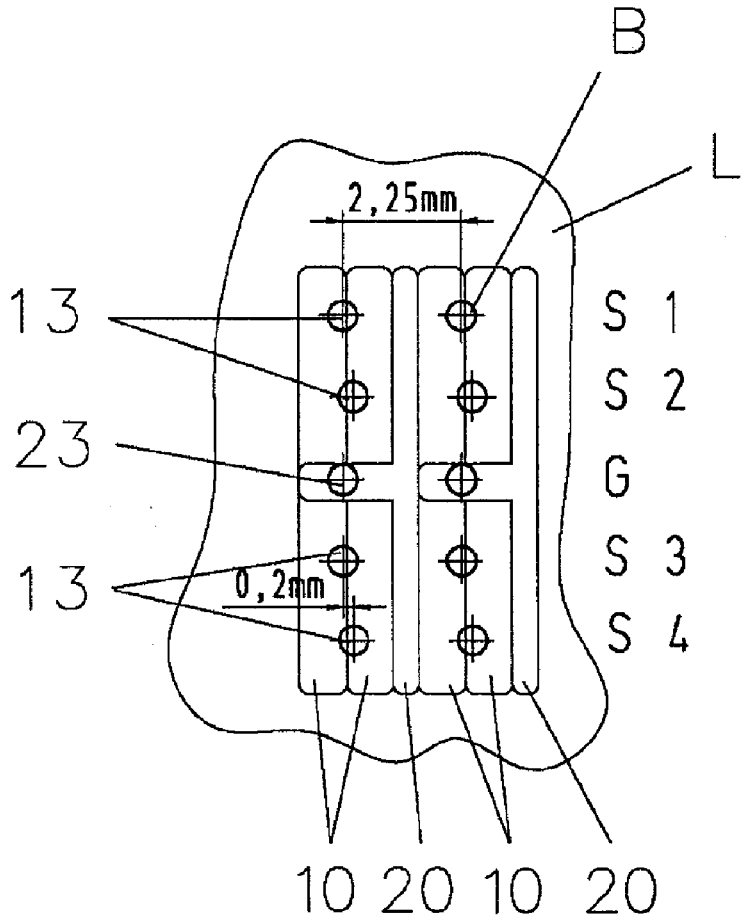
FIG. 9 is a view of the bores in a printed board for the printed board connector, wherein the signaling and shielding modules are also schematically illustrated in this figure.

Due to the above-described contact arrangement, it is possible to offset the arrangement of the bores B (0.2 mm) on a printed board L by the material thickness of the terminal ends 13 only such that a favorable routing of the strip conductors on the printed board is achieved as shown in FIG. 9.

This figure shows a view of the contours of the modules 10, 20 with the terminal ends 13 for the signaling contacts S1, S2, S3, S4 and 23 for the ground connection G of the shielding contact, namely through a quasi-transparent printed board L with the bores B.

Figure 10:
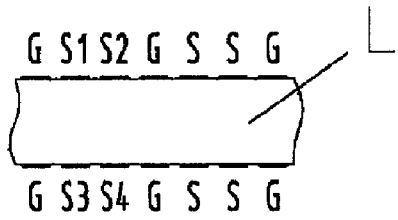
FIG. 10 is a cross-sectional representation of the arrangement of the strip conductors on a printed board.

FIG. 10 shows a significantly enlarged representation of the arrangement of the signaling strip conductors S and the shielding strip conductors G (ground connection) on a printed board L. In this case, the strip conductors S1 and S2 as well as the strip conductors S3 and S4 respectively form a differential conductor pair above and underneath the printed board. A shielding strip conductor G is respectively arranged adjacent thereto and followed by another pair of signal conductors.

What is claimed is:

1. A printed board connector for direct pluggable connections between two printed boards, comprising:

an insulating connector housing with two longitudinal sides, and having spaced webs embedded onto an interior of the longitudinal sides, said connector including a plurality of signaling modules and shredding modules each having plug contacts and terminal ends alternately arranged adjacent one another in the connecting housing, wherein two signaling modules are separated by one shielding module, and wherein the shielding modules have segment-shaped press-on zones between the longitudinal sides of and wherein the housing has a top wall and a plurality of chamber walls, each of the springable plug contacts being disposed below the top wall and being arranged in each of the chamber walls the connector housing.

2. The printed board connector according to claim 1, wherein the shielding module comprises a flat shielding contact with two plug contacts and one terminal end turned perpendicular to the flat shielding contact.

3. The printed board connector according to claim 1, wherein an alternative shielding module comprises a flat contact with two plug contacts and one terminal end turned perpendicular to a flat contact molded within an insulating member.

4. The printed board connector according to claim 3, wherein the terminal end of the shielding module is in a form of a part that is bent out of the flat contact at a right angle, and wherein the terminal end protrudes into a recess in the insulating member.

5. The printed board connector according to claim 4, wherein the shielded module is arranged between two signaling modules, and wherein the right-angled terminal end is vertically arranged between the signaling contacts of adjacent signaling modules.

6. The printed board connector as claimed in claim 1, wherein signaling contacts are arranged asymmetrically by the passageway through the insulating member, wherein the plug contacts are centrally arranged on the plug side of the insulating member and the terminal ends are arranged asymmetrically aligned to an outer peripheral surface of the insulating member.

7. The printed board connector as claimed in claim 1, wherein the signaling contacts are arranged at different heights relative to the height of the insulating member, wherein one signaling contact is arranged at a first quarter height, and a second signaling contact is arranged at a third quarter height relative to the height of the insulating member.

8. The printed board connector according to claim 4, wherein the shielding module has segment-shaped press-on zones lying opposite to one another for fixing the module between the longitudinal sides of the connector housing.

9. The printed board connector according to claim 1, wherein two adjacently arranged signaling modules are respectively inserted into an intermediate space between two webs within the connector housing.

10. The printed board connector according to claim 1, wherein a shielding module is inserted between two respective signaling modules, in a vertical space between two opposing webs of the two longitudinal sides of the connector housing.

11. The printed board connector according to claim 1, wherein the connector housing features insertion slots into which the shielding modules are inserted.

12. The printed board connector according to claim 1, wherein the boss and recess have complementary shapes.

13. The printed board connector according to claim 12, wherein the boss comprises a button.

* * * * *

UNITED STATES PATENT AND TRADEMARK OFFICE

CERTIFICATE OF CORRECTION

PATENT NO. : 7,229,319 B2
APPLICATION NO. : 11/424776
DATED : June 12, 2007
INVENTOR(S) : Dahms et al.

It is certified that error appears in the above-identified patent and that said Letters Patent is hereby corrected as shown below:

Claim 1, Col. 5, line 12, "shredding" should be --shielding-- and

Claim 1, Col. 5, line 16, after the wording "separated by one shielding module," the following language should be inserted --wherein the signaling module has signaling contacts with springable plug contacts and terminal ends molded in a disk-shaped insulating member, a slot is arranged in the insulating member between the terminal ends, one of the two adjacent signaling modules is respectively turned by 180° about the position of the signaling contacts, and the signal modules are clipped together by a boss and a recess on outer peripheral surfaces of the insulating members--

Signed and Sealed this
Twenty-fifth Day of January, 2011

David J. Kappos

David J. Kappos
*Director of the United States Patent and Trademark Office*